United States Patent [19]

LaDelfa et al.

[11] 4,212,112

[45] Jul. 15, 1980

[54] METHOD FOR DRYING SOLID CARBONACEOUS MATERIALS

[75] Inventors: Christopher J. LaDelfa, Tulsa, Okla.; Marvin Greene, Somerset, N.J.

[73] Assignee: Cities Service Company, Tulsa, Okla.

[21] Appl. No.: 937,890

[22] Filed: Aug. 29, 1978

[51] Int. Cl.[2] ..... F26B 3/00

[52] U.S. Cl. ..... 34/9; 34/12; 159/47 R

[58] Field of Search ..... 34/9, 12; 159/47 R

[56] References Cited

U.S. PATENT DOCUMENTS

| | | | |
|---|---|---|---|
| 2,138,048 | 11/1938 | Vesce | 34/9 |
| 2,610,115 | 9/1952 | Lykken | 34/9 |
| 3,520,067 | 7/1970 | Winegartner | 34/9 |
| 3,953,927 | 5/1976 | Hoffert | 34/9 |
| 3,982,325 | 9/1976 | Sigl et al. | 34/9 |
| 3,992,784 | 11/1976 | Verschuur et al. | 34/12 |
| 4,014,104 | 3/1977 | Murphy | 34/9 |

*Primary Examiner*—John J. Camby

*Attorney, Agent, or Firm*—George L. Rushton

[57] ABSTRACT

The material to be dried, such as coal, is mixed with an aromatic liquid, such as benzene, which removes a portion of the available water from the coal. The mixture of water and benzene, called an azeotrope, has a minimum boiling point relative to the surrounding liquid medium and is easily removed from the total mixture as a vapor. The condensed vapor forms two phases which are separated, furnishing a water stream for use elsewhere in the overall coal processing system and a benzene steam for recycle use. The dried coal/benzene slurry is further processed.

7 Claims, 2 Drawing Figures

METHOD FOR DRYING SOLID CARBONACEOUS MATERIALS

BACKGROUND OF THE INVENTION

This invention concerns a process for drying materials. More particularly, it concerns a process for drying solid, moist carbonaceous materials at a relatively low temperature. The utility of the invention lies in its application to the drying of run-of-mine carbonaceous material, such as lignite, preparatory to the gasification of the lignite.

The drying of solid carbonaceous materials, before further processing, is well known. By reducing the moisture level of these materials, the calorific value per unit wt. is enhanced. Many materials, such as coal and mineral ores, are conventionally dried by countercurrent treatment with hot combustion gases. Another method of dehydrating lignite is described in U.S. Pat. No. 2,610,115, in which ground lignite is mixed with a mineral hydrocarbon oil and the mixture is heated to a temperature of 350° F., during which process moisture is removed from the lignite and hydrocarbon vapors are adsorbed within the lignite mass. Another method of drying a wetted material is found in U.S. Pat. No. 3,982,325, in which a solvent medium bath comprising a mixed solvent system having a plurality of layers contacts the wetted material and removes moisture from the wetted material. The wetted solvent is then subjected to azeotropic distillation which regenerates the solvent medium.

SUMMARY OF THE INVENTION

We have now discovered a method for reducing the water content of solid, moist carbonaceous materials, in which a moisture-removing liquid material (which in itself is a product obtained by further processing of the dried solid carbonaceous material) removes at least a portion of the moisture from the solid carbonaceous material. The moisture-removing liquid material forms a liquid mixture with the moisture, this mixture exhibiting a minimum boiling point relative to the boiling points of surrounding mixture compositions. This liquid mixture, called an azeotrope, because of its lower boiling point is preferentially distilled from the system. The temperature of the azeotropic mixture produced is such that waste heat, such as low-pressure steam, is a convenient source of heat to expel the azeotropic mixture from the solid, moist carbonaceous material/moisture-removing liquid material mixture. The serial steps for this process are:

(a) mixing the solid, moist carbonaceous material with a moisture-removing liquid material,
(b) heating the mixture, and
(c) separating an azeotrope from the mixture, thus reducing the moisture content of the solid portion of the mixture.

The present invention is more than just a process for removing water from moist carbonaceous material. The invention includes a thermal process, in that it concerns the use of a direct contact, low temperature contactor, as opposed to a prior art high temperature, hot flue gas/blown coal transport dryer. The invention also concerns a mass transfer process, since the drying is accomplished in the liquid phase, as opposed to the gas phase (hot flue gas) noted above. The invention also concerns a solids removal process, since a relatively dry slurry of coal and moisture-removing liquid material is withdrawn from a contacting area, and this slurry can be readily pressurized by conventional pumping.

DETAILED DESCRIPTION OF THE INVENTION

Figure 1:
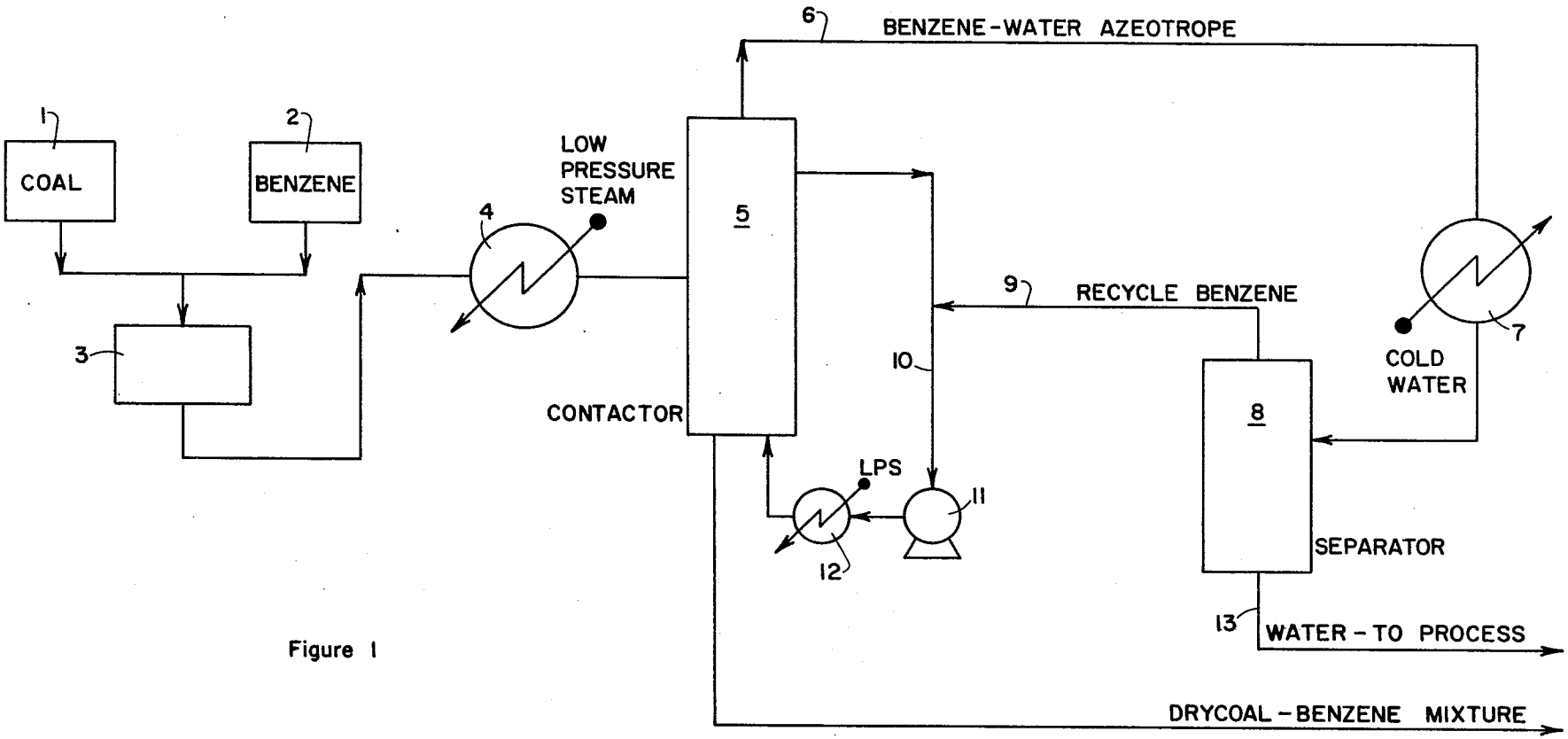
FIG. 1 shows a schematic representation of the process of the invention.
Figure 2:
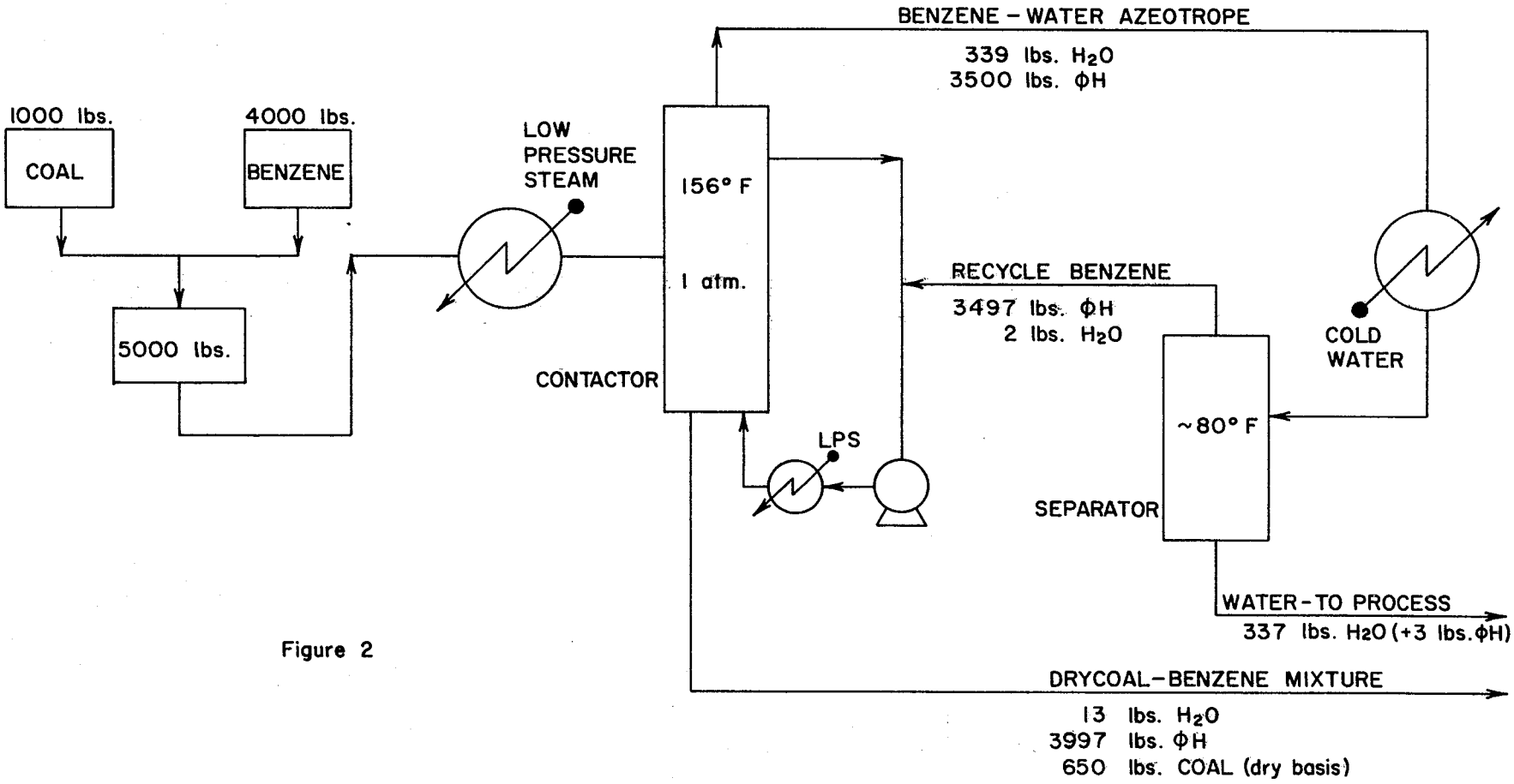
FIG. 2 shows a process flow-sheet of the invention.

The solid, moist carbonaceous materials that can be used in this process are broadly classified as coals. For the purposes of this invention, we include not only the recognized coals, such as anthracite, bituminous, and lignite, but also peat and humates. Such materials, in run-of-mine condition, have moisture contents varying from about 10 to about 90 wt.%. Although solid carbonaceous materials are our primary concern, the process can also be used to reduce the moisture content of materials such as tar sands, thickened sewage sludge, and thickened ore concentrates.

Broadly, the moisture-removing liquid material used in this invention can be any of the multitude of organic and inorganic compounds that form azeotropes with water. A listing of these materials can be found in "Advances in Chemistry Series" (No. 35; American Chemical Society, Washington, D.C.; 1962). Many of these materials are excluded from practical consideration due to price, availability, corrosiveness, reactivity, etc. The coal-drying process of this invention is a portion of a larger processing plant in which coal is converted to a number of industrial products. For instance, some of the coal is hydropyrolyzed to give, among other products, benzene, toluene, and xylenes. Since these compounds form azeotropes with water and since they are products of the overall process, they are obviously the preferred materials to be used as moisture-removing liquid materials. A commercially-pure benzene stream, easily obtained by refining the crude product stream of the overall process and containing minor amounts of toluene and xylenes, is the most preferred material. We define our preferred benzene stream as containing 90 mol.% benzene and lesser mol.%s of toluene and xylenes.

The preferred raw materials for the drying process, coal and benzene, are mixed together, and the mixture is wet-ground to form a slurry. Alternatively, the coal can first be dry-ground and then mixed with benzene. The wet solid/benzene ratio varies, depending on the moisture in the feed stock and the pumping characteristics of the mixture. For a lignite having approximately 35% moisture content, a mixture of 100 pounds lignite and 124 pounds benzene gives a usable slurry. Broadly, the solid/benzene ratio can vary from about 2/1 to about 1/20, with a ¼ ratio being desired.

It is desirable to have the solid material coarse-ground to a size of less than 1 inch before mixing with the benzene to form a slurry. During the finer-grinding of the solid material, the particle size of the solid is reduced to a range of 20–400 mesh, with a size of about 100 mesh being desired. The particle size of the ground solid is not critical for the operation of the invention as long as the largest sized particles in the grind are no larger than about 20 mesh. The cost of grinding to a finer particle size must be considered against the improved moisture-removal from the greater surface area exposed. This present process is meant to remove water from solids in which the water does not separate from the solid on standing. Such water, apart from that found in slurries or on the surface, includes connate, bound, and hydrate waters.

The mixture of solid, moist carbonaceous material and moisture-removing liquid material is then heated. This heating can take place in any proper vessel, using good engineering techniques and practices. One way of assuring proper heating, good contact between solids and benzene, and a proper residence time is the use of a closed contactor, employing an expanded bed or a fluidized bed, as shown in the drawing. Due to the physical properties of the water-benzene azeotrope formed, the use of waste or low pressure (100 psi and lower) steam is convenient for the invention. The mixture of carbonaceous material and liquid material can be heated to a temperature of 156°-320° F., preferably 200°-230° F. Using a residence time in the contactor of between 10 minutes and 4 hours, with a preferred time of 30-60 minutes, moisture is removed from the coal and forms an azeotrope with the benzene. Alternatively, an inert gas stream may be introduced at the bottom of the reactor to promote agitation and contact between the solid and liquid phases. Due to the lower boiling point of the azeotropic mixture, water is removed from the coal, and the coal is discharged from the contactor with a reduced moisture level.

The slurry of benzene and partially-dried coal is then sent on to the next step of the process. A stream of make-up, or recycle, benzene can be obtained from downstream processing of the coal, such as in hydropyrolysis. Recycle benzene is also obtained from the condensation and separation of the azeotropic mixture.

The azeotrope exiting the expanded bed contactor at about atmospheric pressure has a temperature of about 156° F. (69° C.) and contains about 8.8 wt.% water (30 mole % water - 70 mole % benzene). When the azeotrope is cooled, separate phases of water and benzene form, and separation of these phases provides recycle benzene to form a mixture with incoming coal and a water stream which can be used in various places throughout the overall process. In water-short areas, the use of this water stream can be beneficial and advantageous.

The system involving this process can be run at sub-atmospheric, atmospheric, or super-atmospheric pressure. It is convenient to operate at atmospheric pressure. For conditions other than atmospheric pressure, the process temperatures at various points, as well as the azeotrope boiling point and percentage make-ups, will vary accordingly.

After the azeotrope exits the contactor bed, the remaining coal/benzene mixture can also be removed, preferably at a point below the exiting point of the azeotrope. One convenient removal point for the mixture having a reduced moisture content is an internal downcomer pipe located below the exiting point of the azeotropic vapor. Another removal point is at the discharge side of the recirculating pump. As an example, the exiting slurry comprises about 50 wt.% coal, 48 wt.% benzene and 2 wt.% moisture.

The invention will be better understood by referring to the figure. Run-of mine coal, ground to pass a 100 mesh screen and having about 35 wt.% moisture, is stored in hopper 1. An aromatic liquid, acting as a moisture-removing liquid material, is stored in tank 2. The aromatic is preferably a compound, or mixture of compounds, produced downstream in the coal processing plant. The aromatic liquid can be benzene, toluene, or a xylene, or a mixture. A preferred liquid has at least 90 mol.% benzene, the remainder being slight amounts of toluene and xylene, and, possibly, water. Coal, at the rate of 1000 lbs./hr. is moved to mixing tank 3 and mixed with 4000 lbs./hr. of aromatic liquid, forming a pumpable mixture whose solid/liquid ratio is about ¼. This mixture is pumped through heat exchanger 4, where low-pressure (60 psi) waste-heat steam is used to heat the mixture to about 176° F. (80° C.). The heated mixture, comprising moist coal and aromatic liquid (benzene), enters contactor 5. In the contactor, a water/benzene azeotrope forms. This azeotrope, having a boiling point lower than other compositions in the mixture, vaporizes in the contactor and exits overhead in line 6, the azeotrope containing 339 lbs./hr. water and 3500 lbs./hr. benzene. The azeotrope, cooled in heat exchanger 7, condenses and forms separate layers (of 337 lbs./hr. water plus 3 lbs./hr. benzene and 3497 lbs./hr. benzene plus 2 lbs./1 hr. water) in separator 8. The top layer of benzene, containing a small amount of water (about 0.05 wt.% water at 25° C. (77° F.), is removed as recycle benzene and is returned to contactor 5 by way of lines 9 and 10, pump 11, and heat exchanger 12. The bottom layer of water from separator 8 is removed by line 13 and can be used in further process steps.

Also exiting contactor 5 is another portion of benzene, typically at a draw-off level higher than the inlet level. This benzene can be recycled to contactor 5 through line 10, pump 11, and heat exchanger 12.

A major amount of the mixture entering contactor 5 exits the bottom of 5 as a mixture of benzene (containing a small amount of water) and coal having a lower moisture level than does the coal in hopper 1. This mixture can be separated downstream, such as by decantation or filtration, with the partially-dried coal being treated in another process and the benzene being recycled, such as to tank 2.

Although not shown in the figure, the partially-dried coal (moisture level=2 wt.%) can be hydrotreated downstream of the dryer, with the result that a mixture of $C_{1-3}$ hydrocarbons, benzene, toluene, xylene, and char are produced. The benzene-toluene-xylene mixture can be used as the moisture-removing liquid material in the present invention, while the light hydrocarbons and char can be used in separate reactions.

We claim:

1. A process for reducing the moisture content of solid, moist carbonaceous materials, using a closed contactor, comprising (a) grinding the solid material to a size range of 20-400 mesh, (b) mixing the solid, moist carbonaceous material with a moisture-removing liquid selected from the group consisting of benzene, toluene, and xylenes, these materials being capable of forming an azeotrope with the moisture, with the ratio of solid material to moisture-removing liquid in the mixture varying from about 2/1 to about 1/20, (c) heating the mixture, and (d) separating the azeotrope from the mixture, thus reducing the moisture content of the solid portion of the mixture.

2. The process of claim 1 wherein (a) the solid carbonaceous material is selected from the group consisting of anthracite coal, bituminous coal, lignite, peat, and humates, (b) the mixture is heated to a temperature of 156°-320° F. (69°-160° C.), (c) the mixture is in contact with the moisture in removing material for a period of from about 10 minutes to about 4 hours, and (d) the moisture-removing liquid is benzene.

3. The process of claim 2 wherein (a) the mixture is heated to a temperature of 200°-230° F. (93°-110° C.), (b) the mixture is in contact with the moisture-removing material for a period of 30-60 minutes, (c) the solid material is ground to about 100 mesh, and (d) the ratio of solid/liquid in the mixture is about ¼.

4. The process of claim 1 wherein the separated azeotrope is further processed to yield a moisture-rich fraction and a moisture-removing material-rich fraction.

5. The process of claim 1 wherein an inert gas is added to the heated mixture in the contactor, to assist in agitation and removal of the overhead azeotrope.

6. The process of claim 1 wherein the mixture is heated by a low level heat source.

7. The process of claim 6 wherein the low level heat source is low pressure steam of from 10 to about 100 psi.

* * * * *